US006110633A

United States Patent [19]

Atarashi et al.

[11] Patent Number: 6,110,633

[45] Date of Patent: Aug. 29, 2000

[54] COLOR MAGNETIC TONER AND PROCESS FOR PRODUCING THE SAME

[75] Inventors: Takafumi Atarashi, Tokyo, Japan; Katsuto Nakatsuka, 3-5 1403, Moniwadai 4-chome, Taihaku-ku, Sendai-shi, Miyagi, Japan

[73] Assignees: Nittetsu Mining Co., Ltd., Tokyo, Japan; Katsuto Nakatsuka, Miyagi, Japan

[21] Appl. No.: 09/202,194

[22] PCT Filed: Jun. 6, 1997

[86] PCT No.: PCT/JP97/01941

§ 371 Date: Mar. 29, 1999

§ 102(e) Date: Mar. 29, 1999

[87] PCT Pub. No.: WO98/05605

PCT Pub. Date: Feb. 12, 1998

[30] Foreign Application Priority Data

Jun. 10, 1996 [JP] Japan ..... 8-147420

[51] Int. Cl.[7] ..... G03G 9/083

[52] U.S. Cl. ..... 430/106.6; 430/137

[58] Field of Search ..... 430/45, 106.6, 430/137; 428/403

[56] References Cited

U.S. PATENT DOCUMENTS

| | | | |
|---|---|---|---|
| 4,758,490 | 7/1988 | Kitabatake | 430/106.6 |
| 5,194,356 | 3/1993 | Sacripante et al. | 430/106.6 |
| 5,763,085 | 6/1998 | Atarashi et al. | 428/403 |

*Primary Examiner*—John Goodrow

*Attorney, Agent, or Firm*—Sughrue, Mion, Zinn, Macpeak & Seas, PLLC

[57] ABSTRACT

It is to provide a powder for use as a raw material for color magnetic toners for use in a color copier or the like which have been colored vividly as well as in white, and a dry color magnetic toner which is obtained from the raw material. The dry color magnetic toner comprises a powder comprising a light-interference multilayered film formed on a magnetic particle and at least one organic polymer coating film or a colored film on the surface of the powder. The process for producing the dry color magnetic toner comprises coating the surface of the powder having thereon a light-interference multilayered film with at least one organic polymer coating film.

5 Claims, 1 Drawing Sheet

COLOR MAGNETIC TONER AND PROCESS FOR PRODUCING THE SAME

TECHNICAL FIELD

The present invention relates to a composite powder for use as a raw material for color magnetic toners, color magnetic inks, or the like, and relates to a process for producing the composite powder.

BACKGROUND ART

The electrophotographic image-forming methods currently used in copying, printing, etc. include a two-component development method in which a magnetic carrier and a toner as a colorant are used in combination, and a one-component development method which uses a toner which itself is magnetic.

Because of the nonuse of a carrier, the one-component development method has many advantages, for example, that the development apparatus is simple (the sizes of the development apparatuses are about a half to one-third the sizes of those used in the two-component development method), and that the management of developers is easy. However, when this method is used for forming color images, darkish magnetic toners should be used and images of vivid colors cannot be obtained.

The reason for this is as follows. In order to obtain clear color images by the one-component development method, magnetic toners themselves should be colored vividly. However, since the magnetic material particles serving as the bases thereof are generally black, merely forming a colored film directly on the surface of such base particles results in a dark color as a whole.

Accordingly, the two-component development method is employed at present for forming color images. However, since color copying necessitates four colors, i.e., three primary colors and black, a larger development apparatus is necessary as a matter of course.

Additionally, there are problems concerning the management of developers, the treatment of carriers resulting from development, etc.

Consequently, if vivid colors are obtainable by the one-component development method, the use of this method is preferred because the copier is simple and compact and the problems concerning the management of developers and the treatment of carries are eliminated. However, magnetic toners for the one-component development method which are suitable for the formation of color images have not been obtained so far.

Under these circumstances, the present inventors previously proposed: a method which comprises dispersing a base particle into a metal alkoxide solution and hydrolyzing the metal alkoxide to thereby form on the surface of the base particle a metal oxide film having a uniform thickness of 0.01 to 20 $\mu$m (Unexamined Published Japanese Patent Application No. 6-228604); a functional powder having thereon plural layers of a metal oxide thin film and a metal thin film alternatively (Unexamined Published Japanese Patent Application No. 7-90310); and a process comprising heating a powder coated with a multilayered metal oxide film to thereby produce a powder having a multilayered metal oxide film which is denser and more stable (WO96/28169).

The above-described powder having plural layers of a metal oxide film or a metal film can be made to have a special function by regulating the thickness of each film. For example, when coating films having different refractive indexes are formed on the surface of the base particle in a thickness corresponding to one-fourth the wavelength of an incident light, then a powder which reflects all of the incident light is obtained. This suggests the possibilities that by applying the above technique to the base particle of a magnetic material, a magnetic powder for magnetic toners might be produced which wholly reflects light and has a vivid white color, and that further forming a colored layer on the surface of this magnetic powder and then forming a resin layer thereon might yield a color magnetic toner colored vividly.

Accordingly, an object of the present invention is to further develop the above-described techniques proposed by the present inventors to thereby provide a color magnetic toner with which a vivid color is obtained even by the one-component development method.

DISCLOSURE OF THE INVENTION

The above object has been accomplished with the following toners according to the present invention:

(1) A color magnetic toner comprising a base particle of a magnetic material, wherein a light-interference multilayered film is formed on the base particle, and an organic polymer film is formed on the light-interference multilayered film;

(2) The color magnetic toner according to the above (1), wherein the light-interference multilayered film reflects light in the visible region;

(3) The color magnetic toner according to the above (1) or (2), wherein the organic polymer film contains a coloring agent;

(4) The color magnetic toner of any one according to the above (1) to (3), wherein the light-interference multilayered film comprises plural layers of a metal compound film and/or a metal film.

The similar object has been accomplished also with the following process according to the present invention:

(5) A process for producing a color magnetic toner, comprising: forming a multilayered film comprising a metal compound and/or a metal on a particle of a magnetic material; and then forming an organic polymer film by a polymerization method.

According to the constitutions described above, a color magnetic toner which, even if used as a one-component system, is capable of forming an image of a vivid color can be provided by forming a light-interference multilayered film comprising a metal compound and/or a metal on a magnetic material particle to give a powder of white or another desired color according to the film constitution and further forming thereon an organic polymer film as a binder.

By incorporating a coloring agent into the organic polymer film, a more vivid color can be obtained.

The color magnetic toner according to the present invention will be explained below in detail based on preferred embodiments thereof.

The magnetic material particle which serves as the base of the color magnetic toner of the present invention can be used as a magnetic material particle conventionally used as the base of magnetic toners. Typical examples thereof include powders of metals, such as iron, cobalt, and nickel, powders of alloys thereof, and powders of magnetic sinters, such as iron nitride.

However, it is preferred to use a magnetic material having a high magnetization because a magnetic material particle of a smaller size tends to be used so as to heighten resolution. Preferred is a magnetic material which has a magnetization of 90 emu/g or more, preferably 150 emu/g or more, when a magnetic field of 10 kOe is applied to the powdered magnetic material. A magnetic material having such a high magnetization can give a raw-material powder giving a color magnetic toner which as a whole has a magnetization as high as from 10 to 90 emu/g (upon application of a magnetic field of 10 kOe) even when it contains a binder resin, a charge regulator, a coloring agent, etc.

The shape of the magnetic material particle may have any of isotropic shapes, such as sphere, nearly spherical shapes, and regular polyhedrons; polyhedrons, such as rectangular parallelopipeds, spheroids, rhombohedrons, plates, and prisms; and amorphous shapes.

In order to obtain a color magnetic toner having a vivid color in the present invention, it is necessary to color the magnetic material particle in white or another vivid color. For attaining this, a multilayered film having the property of causing light interference is formed on the magnetic material particle.

The light-interference multilayered film is constituted by superposing many thin films of a metal or metal compound. In forming the multilayered film, a function of reflecting or absorbing incident light in a specific wavelength range can be imparted by regulating the thickness of each film or changing the sequence of film superposition or the combination of films. Thus, the magnetic material particles can be colored white or in another vivid color.

Examples of the metal compound used for forming the multilayered film include metal oxides, metal sulfides, metal selenides, metal tellurides, and metal fluorides. Specific examples thereof include zinc oxide, aluminum oxide, cadmium oxide, titanium oxide, zirconium oxide, tantalum oxide, silicon oxide, antimony oxide, neodymium oxide, lanthanum oxide, bismuth oxide, cerium oxide, tin oxide, magnesium oxide, lithium oxide, lead oxide, cadmium sulfide, zinc sulfide, antimony sulfide, cadmium selenide, cadmium telluride, calcium fluoride, sodium fluoride, trisodium aluminum fluoride, lithium fluoride, and magnesium fluoride.

Preferred examples of the metal include silver, cobalt, nickel, iron, and alloys thereof.

Methods for forming the light-interference multilayered film will be explained below.

Usable film-forming methods for both of the metal compound film and the metal film are vapor-phase vapor deposition methods, such as PVD, CVD, and spray drying methods, in which the metal film or metal compound film is vapor-deposited directly on the surface of a magnetic material particle.

With respect to the metal film, the so-called chemical plating method can also be used, in which a magnetic material particle is placed in an aqueous metal salt solution and the metal salt in the solution is reduced to deposit the metal on the surface of the magnetic material particle.

With the current trend toward size reduction in magnetic toners and in magnetic material particles for meeting the desire for higher resolution, it has become necessary to form a uniform film on the surface of a magnetic material particle. With respect to the metal oxide, in particular, the film-forming method previously proposed by the present inventors in Unexamined Published Japanese Patent Application No. 6-228604 or 7-90310 or WO96/28169 is preferred.

Specifically, the proposed method comprises dispersing a magnetic material particle into a metal alkoxide solution, hydrolyzing the metal alkoxide to form a uniform thin film of a metal oxide on the surface of the magnetic material particle, drying the coated particle, and repeating these steps. If necessary, steps for forming a thin metal film may be conducted before or after repetitions of those steps for forming a metal oxide film or between repetitions thereof. Thus, a multilayered film comprising metal oxide films alone or a metal oxide film and a metal film can be obtained. The metal alkoxide is selected from alkoxides of zinc, aluminum, cadmium, titanium, zirconium, tantalum, silicon, antimony, neodymium, lanthanum, bismuth, cerium, tin, magnesium, lithium, and lead.

By heating the multilayered film, the reflectance thereof can be heightened or the multilayered film can be made to be denser and more stable.

Besides being used for metal oxide film formation, this metal alkoxide method is applicable to the formation of metal sulfide films.

In thus forming metal compound films or metal films, the magnetic material particles can be colored in a desired tint by regulating the thickness of each film. For example, when thin films of metal compounds having different refractive indexes are formed each in a thickness corresponding to one-fourth the wavelength of an incident light, the magnetic material particles can be made to reflect all of the incident light and hence have a white color.

Consequently, the thickness of each film of the light-interference multilayered film and the total thickness of the multilayered film are determined so that the magnetic material particles assume a desired color.

An organic polymer film serving as a binder is formed on the surface of the multilayer coated-magnetic material particles. Thus, a color magnetic toner colored vividly is obtained.

For forming an organic polymer film, the PVD, CVD, or spray drying method or the like can be used to directly coat the surface of the multilayer coated-magnetic material particles with an organic polymer film. It is, however, preferred in the present invention to use a polymerization method for the film formation so as to enhance adhesion.

A preferred polymerization method can be suitably selected according to the kind of the organic polymer. Specifically, an emulsion polymerization method, a suspension polymerization method, a seed polymerization method, an in situ polymerization method, and the like can be employed according to the kinds of organic polymers. For some kinds of organic polymers, a phase separation method can also be employed.

Organic polymers for use as binder resins for magnetic toners can be used without particular limitations, as long as films of these polymers can be formed by any of the polymerization methods enumerated above. For example, the following polymers are usable.

Examples of the usable organic polymers include oligomers and polymers of aromatic hydrocarbons (for example, polystyrene, styrene-α-methylstyrene copolymers, styrene-vinyltoluene copolymers); olefin oligomers and polymers (for example, polypropylene, polyethylene, polybutene); vinyl oligomers and polymers comprising copolymers of monomers (for example, ethyl acrylate, methyl methacrylate, ethyl methacrylate, acrylonitrile, polyacrylic acid, polymethacrylic acid, vinyl acetate); oligomers alone (for example, diene oligomers, such as polybutadiene, polypentadiene, and polychloroprene; and ester oligomers, such as polyesters, and copolymers of these oligomers); copolymers made up of two or more of the above monomers and oligomers (for example, hydrocarbon monomers and oligomers, olefin oligomers, vinyl monomers and oligomers, polychloroprene monomers and oligomers, and ester monomers and oligomers); waxes (for example, natural waxes, polyethylene wax); and alkyd resins (for example, rosin-modified alkyd resins).

The organic polymer film is formed in such an amount that when the color magnetic toner is deposited on a paper surface, the polymer film spreads to prevent the toner particles from falling or separating from the paper surface. However, from the standpoint of relationship with the coloring agent described below, the organic polymer film coating is preferably formed in such an amount that when the toner is deposited on a paper surface, the organic polymer spreads over an area about four times the area occupied by the magnetic material particles.

The color magnetic toner of the present invention is characterized in that the toner itself has a vivid color because the light-interference multilayered film formed on the magnetic material particle causes an incident light to undergo interference and thus assumes a color. Consequently, an organic polymer film functioning only as a binder is sufficient, and it may be transparent. However, since deposition of the color magnetic toner on a paper surface may result in uncolored areas due to spaces among magnetic material particles, it is preferred to incorporate a coloring agent into the organic polymer film so that the spread organic polymer film resulting from toner deposition is utilized to color the areas surrounding the deposited toner.

Examples of the coloring agent used for coloring the organic polymer film include yellow, magenta, and cyan coloring agents. The following organic dyes and organic pigments can be used for each color.

Organic Dyes:

a. Yellow: monoazo dyes, azomethine dyes, oil dyes, etc.

b. Magenta: thioindigo dyes, xanthene dyes, 2,9-quinacridone dyes, oil dyes, etc.

c. Cyan: copper phthalocyanine dyes, oil dyes, etc.

Organic Pigments:

a. Yellow: bisazo pigments, benzidine pigments, phorone yellow pigments, etc.

b. Magenta: quinacridone pigments, anthraquinone pigments, rhodamine pigments, naphthol type insoluble azo pigments, etc.

c. Cyan: phthalocyanine pigments, etc.

These coloring agents may be contained in the organic polymer film preferably in such an amount that when the color magnetic toner is deposited on a paper surface, coloring with the coloring agents is possible evenly over an area about 2 to 10 times the projected area of the magnetic material particles.

The color magnetic toner of the present invention comprises the magnetic material particle, the light-interference multilayered film, and the organic polymer film described above as essential components. Besides these, the toner may further contain a charge regulator, a fluidizing agent, and a surface lubricant incorporated in the organic polymer film.

The charge regulator is an additive added for regulating the electrification characteristics of the color magnetic toner. Usable as the charge regulator are organic acids, surfactants, and dielectric substances. Examples of charge regulators usable for toners of the positive electrification type include metal complexes of alkylsalicylic acids, metal complexes of dicarboxylic acids, metal salts of polycyclic salicylic acids, and metal salts of fatty acids. Examples of charge regulators usable for toners of the negative electrification type include quaternary ammonium salts, benzothiazole derivatives, guanamine derivatives, dibutyltin oxide, nitrogen-containing compounds, chlorinated paraffins, and chlorinated polyesters.

The fluidizing agent is an additive added for improving the flowability of the color magnetic toner to thereby prevent unnecessary toner particles from remaining on a paper surface. Examples include colloidal silica, aerosil, titanium oxide powder, alumina powder, zinc oxide powder, and powder of a fatty acid metal salt.

The surface lubricant is an additive added for preventing the color magnetic toner from adhering to the fixing roll or other parts of a developing machine. Examples include low molecular polyethylene, and low molecular polypropylene.

The upper limit of the content of these additives in the organic polymer film is preferably about 60% by weight in terms of a total amount. If the content of the additives exceeds the upper limit, practical magnetic properties as a color magnetic toner cannot be obtained.

By combining the elements described above, a color magnetic toner having a vivid color can be obtained.

BEST MODES FOR CARRYING OUT THE INVENTION

Figure 1:
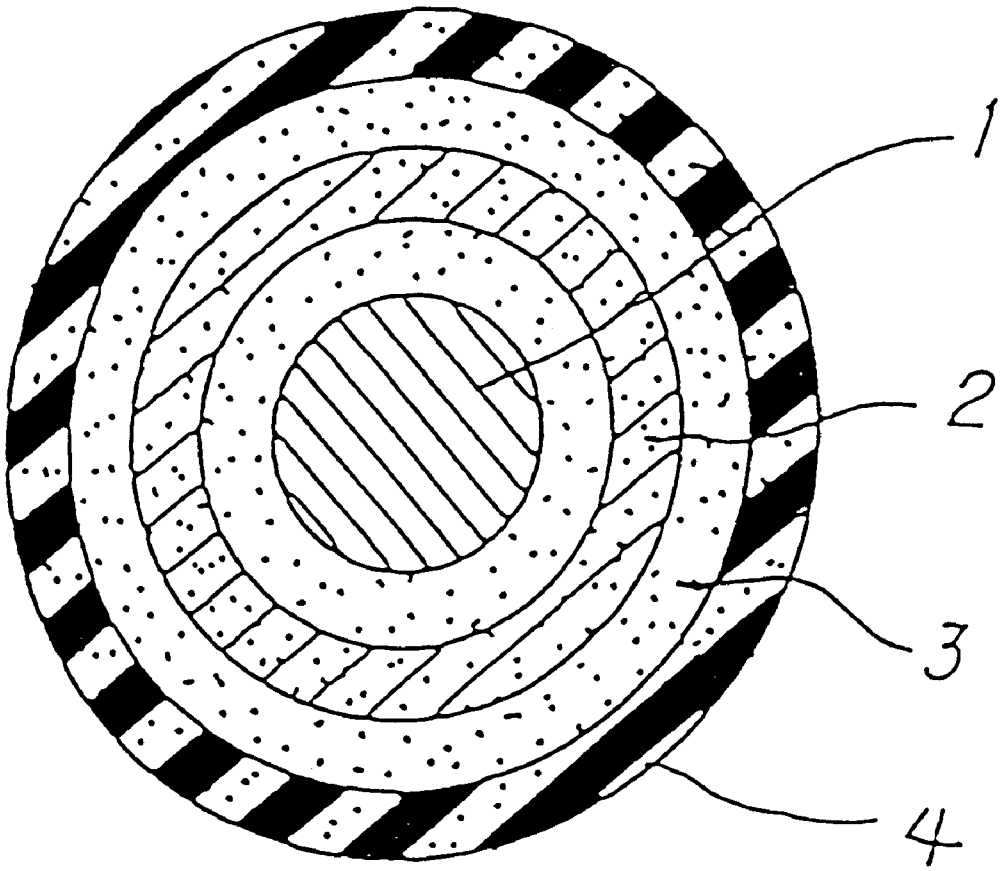
FIG. 1 is a diagrammatic sectional view illustrating one embodiment of the color magnetic toner according to the present invention. As shown in the figure, this particle consists of: a magnetic material particle 1 as a base particle; a light-interference multilayered film formed on the base particle and comprising a metal compound film 2 and another metal compound film 3 superposed thereon; and an organic polymer film 4 with which the outermost surface is covered. One of the metal compound film 2 and the metal compound film 3 may be a metal film.

The present invention can be understood more clearly by reference to the following Examples and Comparative Example. However, the invention should not be construed as being limited by the following Examples.

EXAMPLE 1

Process for Producing Oxide-coated Powder

First layer: Silica coating:

Into 100 ml of ethanol was dispersed 10 g of a carbonyl iron powder (average particle diameter, 1.8 μm) manufactured by BASF. The container was heated in an oil bath to keep the liquid temperature at 55° C. Thereto were added 6 g of silicon ethoxide, 6 g of ammonia water (29%), and 8 g of water. This mixture was allowed to react for 2 hours under stirring. After the reaction, the reaction mixture was diluted and washed with ethanol and filtered. The solid matter was dried in a vacuum dryer at 110° C. for 3 hours. After the drying, the resultant powder was heated with a rotary tubular oven at 650° C. for 30 minutes to obtain silica-coated powder A.

The film thickness of the silica-coated powder A obtained was 75 nm. This powder had excellent dispersibility.

Second layer: Titania coating:

After the heating, 10 g of the silica-coated powder A obtained was redispersed into 200 ml of ethanol. The container was heated in an oil bath to keep the liquid temperature at 55° C. Thereto was added 5 g of titanium ethoxide. This mixture was stirred. A solution prepared by mixing 30 ml of ethanol with 8.0 g of water was added dropwise to the above mixture over 60 minutes, and the resultant mixture was allowed to react for 2 hours. The particles were then dried in vacuo and heated to obtain silica-titania-coated powder B.

The silica-titania-coated powder B obtained had satisfactory dispersibility and was an independent particle. The titania film of this silica-titania-coated powder B had a thickness of 50 nm.

This powder had a spectral reflection curve having a peak wavelength of 445 nm and had a reflectance at the peak wavelength of 40%. It was vivid blue.

Polystyrene Composite Powder

To 600 g of distilled water was added 500 g of styrene monomer. While this mixture was heated to 70° C. under stirring, sodium lauryl sulfate was added thereto to emulsify the monomer. Subsequently, 25 g of the silica-titania-coated powder B whose surface had been lipophilized with methacrylic acid was added to the emulsion. The resultant mixture was stirred at a high speed to sufficiently mix the ingredients.

A 10% aqueous ammonium persulfate solution was added thereto to initiate a polymerization reaction. The mixture was allowed to react for 4 hours under stirring. After completion of the reaction, the reaction mixture was diluted with 2 liters of distilled water, and the supernatant was discarded by decantation to collect the precipitate. This precipitate was dried on a filter paper to obtain a blue polystyrene-coated powder.

The blue polystyrene-coated powder obtained had a spherical particle shape and had a magnetization of 120 emu/g in a magnetic field of 10 kOe.

EXAMPLE 2

First layer: Silica coating:

Into 100 ml of ethanol was dispersed 10 g of a carbonyl iron powder (average particle diameter, 1.8 μm) manufactured by BASF. The container was heated in an oil bath to keep the liquid temperature at 55° C. Thereto were added 6 g of silicon ethoxide, 6 g of ammonia water (29%), and 8 g of water. This mixture was allowed to react for 2 hours under stirring. After the reaction, the reaction mixture was diluted and washed with ethanol and filtered. The solid matter was dried in a vacuum dryer at 110° C. for 3 hours. After the drying, the resultant powder was heated with a rotary tubular oven at 650° C. for 30 minutes to obtain silica-coated powder B.

The film thickness of the silica-coated powder B obtained was 70 nm. This powder had excellent dispersibility.

Second layer: Titania coating:

After the heating, 10 g of the silica-coated powder B obtained was redispersed into 200 ml of ethanol. The container was heated in an oil bath to keep the liquid temperature at 55° C. Thereto was added 4.7 g of titanium ethoxide. This mixture was stirred. A solution prepared by mixing 30 ml of ethanol with 8.0 g of water was added dropwise to the above mixture over 60 minutes, and the resultant mixture was allowed to react for 2 hours. The particles were then dried in vacuo and heated to obtain silica-titania-coated powder C.

The silica-titania-coated powder C obtained had satisfactory dispersibility and was an independent particle. The titania film of this silica-titania-coated powder C had a thickness of 45 nm.

This powder had a spectral reflection curve having a peak wavelength of 410 nm and had a reflectance at the peak wavelength of 41%. It was vivid violet.

Third layer: Silica coating:

Into 100 ml of ethanol was dispersed 10 g of the silica-titania-coated powder C. The container was heated in an oil bath to keep the liquid temperature at 55° C. Thereto were added 6 g of silicon ethoxide, 6 g of ammonia water (29%), and 8 g of water. This mixture was allowed to react for 2 hours under stirring. After the reaction, the reaction mixture was diluted and washed with ethanol and filtered. The solid matter was dried in a vacuum dryer at 110° C. for 3 hours. After the drying, the resultant powder was heated with a rotary tubular oven at 650° C. for 30 minutes to obtain silica-titania-silica-coated powder D.

The film thickness of the silica-titania-silica-coated powder D obtained was 75 nm. This powder had excellent dispersibility.

Fourth layer: Titania coating:

After the heating, 10 g of the silica-titania-silica-coated powder D obtained was redispersed into 200 ml of ethanol. The container was heated in an oil bath to keep the liquid temperature at 55° C. Thereto was added 5.5 g of titanium ethoxide. This mixture was stirred. A solution prepared by mixing 30 ml of ethanol with 8.0 g of water was added dropwise to the above mixture over 60 minutes, and the resultant mixture was allowed to react for 2 hours. The particles were then dried in vacuo and heated to obtain silica-titania-silica-titania-coated powder E.

The silica-titania-silica-titania-coated powder E obtained had satisfactory dispersibility and was an independent particle. The newly formed titania film of this silica-titania-silica-titania-coated powder E had a thickness of 53 nm.

Polystyrene Composite Powder:

To 600 g of distilled water were added 90 g of styrene monomer and 10 g of butylene acrylate. While this mixture was heated to 70° C. under stirring, sodium lauryl sulfate was added thereto to emulsify the monomers.

Subsequently, 50 g of the silica-titania-silica-titania-coated powder E was added to the emulsion. The resultant mixture was stirred at a high speed to sufficiently mix the ingredients.

A 10% aqueous ammonium persulfate solution was added thereto to initiate polymerization reactions. The mixture was allowed to react for 4 hours under stirring. After completion of the reactions, the reaction mixture was diluted with 2 liters of distilled water, and the supernatant was discarded by decantation. The precipitate was dried on a filter paper to obtain a blue polystyrene-coated powder.

The polystyrene-coated powder obtained had a spectral reflection curve having a peak wavelength of 445 nm and had a reflectance at the peak wavelength of 55%. It was vivid blue. This powder had a magnetization of 78 emu/g in a magnetic field of 10 kOe.

COMPARATIVE EXAMPLE 1

Mere Mixture of Magnetic Material and Pigment

Turkey blue (blue pigment) (average particle diameter, 0.2 μm; reflection peak, 455 μm; reflectance, 55%) was mixed with a carbonyl iron powder (average particle diameter, 1.8 μm) manufactured by BASF, in a weight ratio of 25 g:25 g. This mixture was sufficiently homogenized.

This powder was added to 600 g of distilled water together with 90 g of styrene monomer and 10 g of butylene acrylate. The resultant mixture was heated to 70° C. under stirring. Sodium lauryl sulfate was further added thereto to emulsify the monomers, and this mixture was stirred at a high speed to sufficiently mix the ingredients.

A 10% aqueous ammonium persulfate solution was added thereto to initiate polymerization reactions. The mixture was allowed to react for 4 hours under stirring.

After completion of the reactions, the reaction mixture was diluted with 2 liters of distilled water, and the supernatant was discarded by decantation. The precipitate was dried on a filter paper. As a result, spherical particles were obtained each composed of pigment and iron particles wholly covered with polystyrene and united with each other.

This polystyrene-coated powder A was dark-blue and had a reflection peak at 455 nm and a reflectance reduced to 22%. This powder had a magnetization of 75 emu/g in a magnetic field of 10 kOe.

As apparent from a comparison between Example 2 and Comparative Example 1, it was ascertained that the mere mixing of a pigment with magnetic material particles and a binder resin does not result in an improved color, and that in order for a color magnetic toner having the same magnetization to be superior in color, the magnetic material particles themselves should be colored as in Example 2.

EXAMPLE 3

In 20 g of benzene was dissolved 10 g of oil blue as an organic dye. This solution was mixed with 90 g of styrene monomer and 10 g of butylene acrylate to obtain a starting material for a colored resin.

The above starting material for a colored resin was added to 600 g of distilled water. Thereto was added sodium lauryl sulfate. This mixture was heated to 70° C. under stirring and emulsified.

Subsequently, 50 g of a silica-titania-coated powder E prepared in the same manner as in Example 2 was added to the resultant solution, and this mixture was stirred at a high speed to sufficiently mix the ingredients.

A 10% aqueous solution of ammonium persulfate was added thereto to conduct a polymerization reaction for 5 hours. After completion of the reaction, the reaction mixture was diluted twice with 2 liters of distilled water and washing with decantation. The precipitate was filtrated and washed to obtain blue polystyrene-coated powder B.

The polystyrene-coated powder B obtained had a spectral reflection curve having a peak wavelength of 455 nm and had a reflectance at the peak wavelength of 52%. This polystyrene-coated powder B had a magnetization of 75 emu/g in a magnetic field of 10 kOe.

Using a coater, the polystyrene-coated powders A and B obtained in Example 3 and Comparative Example 1 each was evenly applied in an amount of 1.7 g on an A4 paper sheet for copying over 80% of its area. As a result, the polystyrene-coated powder B obtained in Example 3 colored the paper vivid blue. On the other hand, the polystyrene-coated powder A obtained in Comparative Example 1 colored the paper dark-gray.

INDUSTRIAL APPLICABILITY

As described above, a color magnetic toner which, even if used as a one-component system, can form images of a vivid color can be provided according to the present invention by forming a light-interference multilayered film comprising plural layers of a metal compound layer and/or a metal layer on a magnetic material particle to give a powder of white or another desired color according to the film constitution and further forming thereon an organic polymer film as a binder.

By incorporating a coloring agent into the organic polymer film, a more vivid color can be obtained.

As a result, copiers can be made simpler and more compact, and color printing is possible also in laser printers or facsimile telegraphs employing the same principle. Furthermore, since the color magnetic toner is free from the carrier waste discard associated with the two-component development method, it not only attains a cost reduction but also is advantageous in environmental conservation.

What is claimed is:

1. A color magnetic toner comprising a base particle of a magnetic material, a light-interference multilayered film formed on the base particle, and an organic polymer film formed on the light-interference multilayered film, wherein said light-interference multilayered film has a color other than white and said organic polymer film is transparent.

2. The color magnetic toner according to claim 1, wherein the light-interference multilayered film reflects light in the visible region.

3. The color magnetic toner according to claim 1 or 2, wherein the organic polymer film contains a coloring agent.

4. The color magnetic toner of any one according to claims 1 to 3, wherein the light-interference multilayered film comprises plural layers of a metal compound film and/or a metal film.

5. A process for producing a color magnetic toner, comprising: forming a multilayered film comprising a metal compound and/or a metal on a particle of a magnetic material; and then forming an organic polymer film by a polymerization method, wherein said light-interference multilayered film has a color other than white and said organic polymer film is transparent.

* * * * *